US007174990B2

(12) United States Patent
Stead et al.

(10) Patent No.: US 7,174,990 B2
(45) Date of Patent: Feb. 13, 2007

(54) TANGENTIAL STRESS REDUCTION SYSTEM IN A LOUDSPEAKER SUSPENSION

(75) Inventors: Brendon Stead, Thousand Oaks, CA (US); Clayton Williamson, Moorpark, CA (US); Mark Trainer, Stevenson Ranch, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 0 days.

(21) Appl. No.: 11/053,585

(22) Filed: Feb. 7, 2005

(65) Prior Publication Data

US 2005/0185817 A1 Aug. 25, 2005

Related U.S. Application Data

(63) Continuation of application No. 10/113,627, filed on Mar. 27, 2002, now Pat. No. 6,851,513.

(60) Provisional application No. 60/279,314, filed on Mar. 27, 2001.

(51) Int. Cl.
*H04R 7/00* (2006.01)
*G10K 13/00* (2006.01)

(52) U.S. Cl. ..... 181/172; 181/157; 181/171; 181/173; 381/423; 277/358; 277/402; 277/403

(58) Field of Classification Search ..... 181/173–174; 277/398, 400

See application file for complete search history.

(56) References Cited

U.S. PATENT DOCUMENTS 1,757,107 A * 5/1930 Baltzley ..... 181/164
3,905,448 A 9/1975 Kawakami et al.
3,941,396 A 3/1976 Bailey et al.
4,284,167 A 8/1981 Kozlow et al.
4,836,561 A 6/1989 Lebeck et al.
4,881,617 A 11/1989 Faraone
5,371,805 A 12/1994 Salki et al.
5,418,337 A * 5/1995 Schreiber ..... 181/171
5,797,602 A 8/1998 Less
5,880,412 A * 3/1999 Faraone ..... 181/173
6,026,929 A * 2/2000 Faraone ..... 181/173
6,250,648 B1 6/2001 Ikeda et al.
6,516,077 B1 * 2/2003 Yamaguchi et al. ..... 381/424
6,582,146 B2 6/2003 Raymoure
6,726,213 B2 * 4/2004 Wang ..... 277/400
6,729,624 B1 5/2004 Johnston

* cited by examiner

*Primary Examiner*—Lincoln Donovan
*Assistant Examiner*—Renata McCloud
(74) *Attorney, Agent, or Firm*—The Eclipse Group, LLP

(57) ABSTRACT

The invention is a suspension element having an outer edge and an inner edge. The suspension element, such as a spider or surround, varies in shape along at least a portion of the suspension element to help relieve both the radial and tangential stress placed on the suspension element when it is stretched. The shape employed in the suspension element allows the suspension element to stretch more easily, creating a higher performance speaker of the same size by increasing the diaphragm excursion and voice coil movement.

50 Claims, 9 Drawing Sheets

TANGENTIAL STRESS REDUCTION SYSTEM IN A LOUDSPEAKER SUSPENSION

RELATED APPLICATIONS

This application is a continuation of U.S. application Ser. No. 10/113,627 filed on Mar. 27, 2002 now U.S. Pat. No. 6,851,513, which claims priority to U.S. provisional patent application Ser. No. 60/279,314, filed Mar. 27, 2001, both application of which are incorporated by reference is incorporated into this application in their entirety by reference.

BACKGROUND OF THE INVENTION

1. Field of the Invention

This invention relates to the reduction of tangential and radial stress in a suspension element of a loudspeaker transducer. In this invention, the suspension element, such as a surround or spider, is designed to increase its ability to expand in both the radial and tangential directions.

2. Related Art

Sound reproduction devices such as loudspeakers are utilized in a broad range of applications in many distinct fields of technology, including both the consumer and industrial fields. Sound reproduction devices utilize a combination of mechanical and electrical components to convert electrical signals, representative of the sound, into mechanical energy that produces sound waves in an ambient sound field corresponding to the electrical signal. Thus, variations of electric energy are converted into corresponding variations of acoustic energy, i.e., sound.

Traditional speakers convert the electric energy to sound with one or more drivers that produce sound waves by rapidly vibrating a flexible cone or diaphragm. A diaphragm is usually circular with a central cone-shaped and/or dome-shaped portion that is coupled to a cylindrical former having a coil wire wrapped around the cylinder. Generally, the coil or wire is wrapped around the exterior side of the cylindrical former. The combination former and coil shall be referred to as the "voice coil." The voice coil is typically suspended by a "spider," which is attached to the frame of the speaker. The spider holds the voice coil in position while allowing it to move freely back and forth. The exterior edge of the diaphragm is attached to the frame of the speaker via a surround. Both the spider and the surround generally act as a rim, made of flexible material that spans between the voice coil and the frame and the diaphragm and the frame, respectively.

The surround and the spider act to form the suspension system that positions the voice coil and allows the voice coil to move relative to a transducer magnet(s) when electrical current is directed to the voice coil. The suspension allows the voice coil to rapidly move up and down along the longitudinal axis and vibrate the diaphragm. The suspension needs to be flexible enough to allow for the movement of the voice coil and diaphragm while at the same time keep the diaphragm from wobbling or becoming "de-centered."

Generally, suspension designs are concerned with minimizing the radial stress of the surround caused by the movement of the voice coil and diaphragm. The surround generally has a uniform half circular cross-sectional shape that extends the entire perimeter or circumference of the surround, when the surround is generally circular. Thus, the radius of the half circular cross-section of the surround remains constant along the perimeter of the surround, creating an arched or dome shaped rim about the speaker. Similarly, the spider has a uniform cross-section that extends the entire perimeter of the spider. The cross-section of the spider generally forms uniform corrugations, where the peaks and valleys, i.e., ridges and grooves, typically are of the same radius. For purposes of this application, the terms perimeter and circumference shall be synonymous and may be used interchangeably to define the perimeter of the suspension elements, regardless of their shape.

When the diagram of the speaker is vibrated, the external edge of the diaphragm moves up and down along the longitudinal axis of the speaker. During both the up-stroke and down-stroke of the voice coil, the surround is extended from its resting position to accommodate the movement of the diaphragm and the spider is extended to accommodate the movement of the voice coil. Thus, as the voice coil moves up and down, the cross-sectional shapes of the surround and spider elongate. As the voice coil moves up and down, both radial and tangential stress is placed upon the suspension elements, i.e., the spider and the surround. The radial stress is caused by the extending of the suspension elements in a direction parallel to the outer and inner edges of the suspension elements. The tangential stress, also referred to as "hoop stress", is the stress placed on the suspension elements in a direction perpendicular to the outer and inner edges of the suspension elements. It is the tangential and radial stress on the suspension elements that limits the excursion and stiffness of the diaphragm and movement of the voice coil.

The extent to which the suspension elements limit the amount of excursion of the diaphragm and the movement of the voice coil is dependent upon the size of the suspension elements. The bigger the suspension elements, the more the suspension elements can stretch and allow the diaphragm and voice coil to move more freely. Employing bigger suspension elements, is not, however, a viable solution in a smaller speaker design since the size of the diaphragm must be significantly reduced to accommodate a larger suspension. When a small surround is utilized the excursion of the diaphragm is reduced, limiting the performance of the speakers. Thus, a trade off is made between performance and size when utilizing small speakers, such as those speakers found in laptop computers or small electronic devices. A need therefore exists to design suspension elements that increase the excursion of the diaphragm and to allow more movement of the voice coil by reducing the radial and tangential stress placed on the suspension elements. While addressing this need would help to increase the performance of small speakers, any size speaker could experience increased performance capabilities from such a design.

SUMMARY

The invention provides designs for suspension elements that, in the case of the surround, increases the amount of excursion and linearity of the diaphragm and thereby improves the performance of the speaker. The design of the suspension elements minimizes the stress on the suspension elements by incorporating various geometric designs into the suspension elements that allow the suspension elements to stretch more easily. The design is incorporated in to the suspension elements without modifying the perimeter size of the elements, allowing for greater excursion of the diaphragm and movement of the voice coil in the same size speaker. In addition to improving the excursion, a significant reduction in the stiffness of the suspension elements is also achieved. This allows for greater bass reproduction in the same size speaker. Further, the modifications to the stiffness also allow for a greater range of operation with constant stiffness, which assists in reducing distortion by allowing the force vs. deflection characteristics to be tailored.

Any geometric design that increases the suspension element's ability to stretch without altering the length of its perimeter or without changing its circumference may be utilized. For example, peaks may be incorporated into the suspension element at various points along the suspension element. At the points where the peaks are not incorporated, the suspension element could maintain its generally half-circular or uniformly corrugated cross-sectional shape, as the case may be. Alternatively, on certain areas of the surround, the design of the peaks could be modified to create more of a parabolic cross-section, rather than a half-circular cross-section. The parabolic cross-section may also vary in shape along the surround. By varying the slope of the parabolic cross-section or shifting the parabolic shape from side to side, the surround, when viewed from the top, may have an appearance of sinusoidal wave face, among other things. Similarly, the ridges and grooves of the spider could take on a parabolic shape, or other varying shape along portions of the spider.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
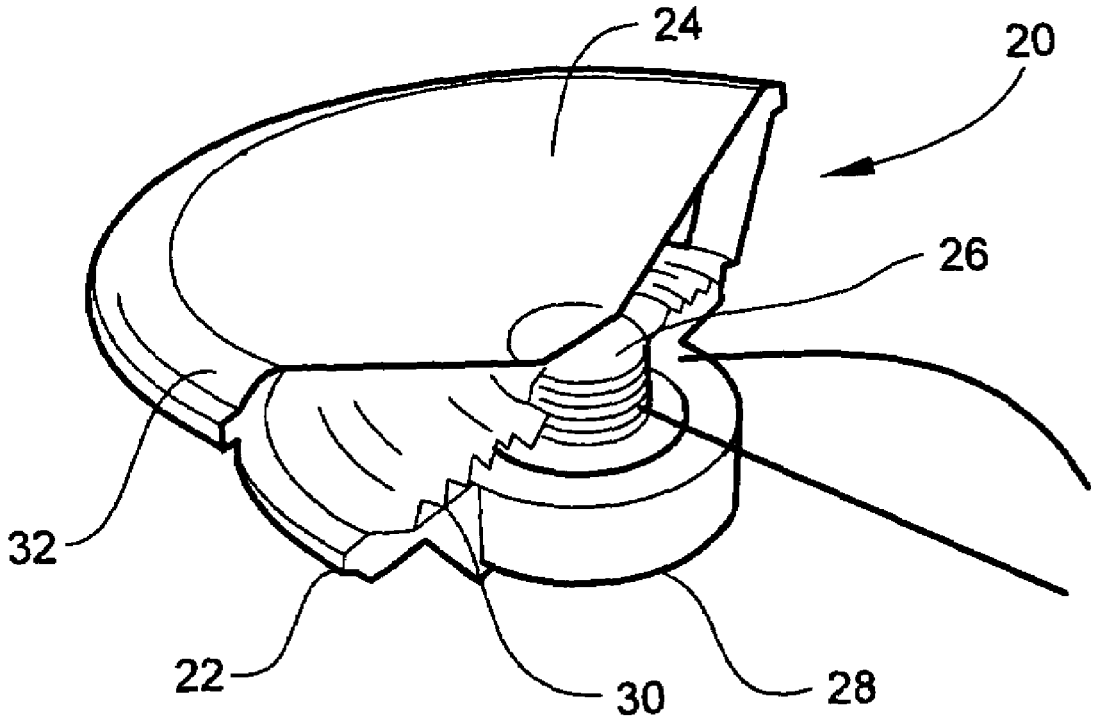
FIG. 1 is a cut away perspective view illustrating the general construction of a speaker system.

FIG. 1 is a cut away perspective view of a speaker 20, which illustrates the general construction of a traditional speaker 20. A speaker 20 generally includes, among other things, a frame 22, a diaphragm 24, a voice coil 26, a magnet 28, a spider 30 and a surround 32.

The voice coil 26 is attached to the underside of the diaphragm 24. The voice coil 26 and diaphragm 24 are attached to the frame 22 via a suspension system, which generally comprises two suspension elements, the spider 30 and the surround 32. The spider 30 is attached to both the frame 22 and the voice coil 26. The spider 30 is attached to the voice coil 26 in manner that holds the voice coil 28 in position, yet allows the voice coil 26 to freely move up and down. Similarly, the diaphragm 24 is attached to the frame 22 via a surround 32. Alternatively, the surround 32 may be attached to a cylinder (not shown) that is in turn attached to the diaphragm 24. In this regard, U.S. patent application Ser. No. 09/346,954, filed Jul. 1, 1999, titled Miniature Full Range Loudspeaker is incorporated by reference. In either instance, the surround 32 is made of a flexible material, generally circular in shape that allows the diaphragm 24 to freely move up and down.

The diaphragm 24 and the voice coil 26 move when electric current is run through the voice coil 26. When the electric current is run through the voice coil 26, a magnetic field is created around the coil 26. The polarity of the magnetic field is continuously reversed, causing the voice coil 26 to alternatively move toward and away from the permanent magnet 28 in the speaker 20. The movement of the voice coil 26 vibrates the diaphragm 24, creating sound. For this reason, both the spider 30 and the surround 32 must be made of flexible material that allows for the movement of the voice coil 26 and vibration of the diaphragm 24.

As, the voice coil 26 moves and the diaphragm 24 is vibrated, the voice coil 26 and the diaphragm 24 move up and down, causing the suspension elements 30 and 32 to expand from their resting position, which is the position of the suspension elements 30 and 32 when the diaphragm 24 and voice coil 26 are not moving. The expansion of the suspension elements 30 and 32 causes the cross-section of the elements 30 and 32, taken across the inner edges 36 and 37 and outer edges 34 and 35 of the elements 30 and 32, to elongate. This causes both tangential stress and radial stress on the suspension elements 30 and 32. Again, radial stress is caused by the extending of the suspension elements 30 and 32 in a direction parallel to the outer edges 34 and 35 and inner edge 36 and 37 of the suspension elements 30 and 32, as shown by reference number 38 in FIG. 2. The tangential stress is the stress placed on the suspension elements 30 and 32 in a direction perpendicular to the outer edges 34 and 35 and inner edge 36 and 37 of the suspension elements 30 and 32, as shown by reference number 40 in FIG. 2. This stress can be minimized by employing different geometric design in the suspension elements 30 and 32 as shown in FIGS. 2–17.

Figure 2:
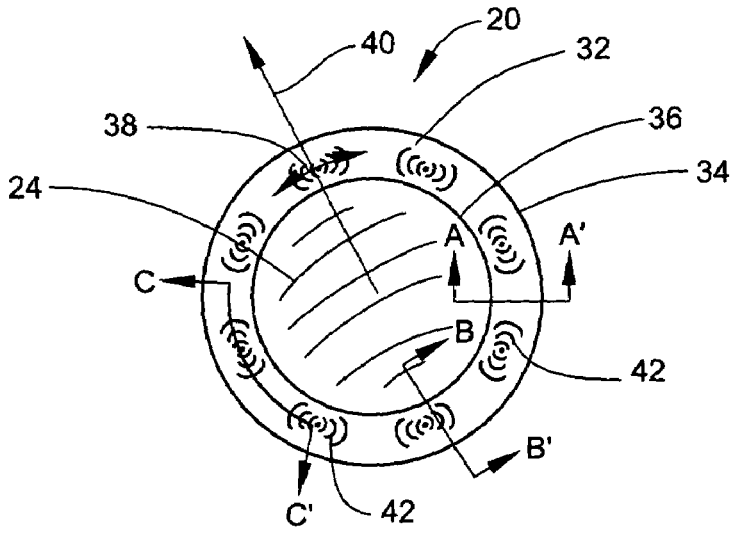
FIG. 2 is a top view of a speaker system having a surround with peaks along the circumference of the surround.
Figure 3:
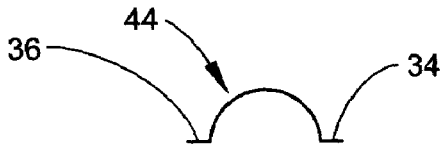
FIG. 3 is a cross-sectional view of the surround in FIG. 2 taken along the line A–A'.

The surround 32 shown in FIGS. 2–5 is one example of a geometric design that may be employed in either suspension element 30 or 32 to minimize the stress on the suspension element 30 and 32. As can be seen in FIG. 2, the surround 32 is designed to include peaks 42, or raised areas, about the perimeter of the surround 32. Although FIG. 2 shows a plurality of peaks 42 placed at predetermined distances about the surround 32, any number of peaks 42 may be utilized. Those areas that do not include peaks 42 may follow the traditional design of a half-circle cross-section having a uniform radius 44, which is illustrated by FIG. 3. FIG. 3 is a cross-section taken along the portion of the surround 32 absent any peaks 42.

Figure 4:
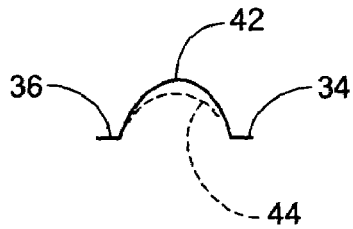
FIG. 4 is a cross-sectional view of the surround in FIG. 2 taken along the line B–B'.

FIG. 4 is a cross-sectional view of the surround 32 taken along a peak 42. This cross-section illustrates that in the areas of the surround 32 that include the peaks 42, the surround 32 extends higher than the traditional design of a half-circle cross-section 44, which is illustrated by FIG. 3 and represented in FIG. 4 by dashed lines. Thus, the radius of the cross-section along a peak 42 is not uniform. In fact, the radius increases toward the center of the cross-section, between the inner and outer edges 36 and 34. This creates a peak 42, which gives that portion of the surround 32 a higher amplitude if the cross-sections were viewed as waves, Rather than taking the form of a half circle, the cross-section of the peaks 42 may be generally formed as a parabola, having slopes on each side of the parabola that generally mirror one another. Other shapes that may also be employed in a suspension element 30 or 32 include, among other things, ellipses, other polynomials, a combination of straight lines and any polynomial shape, shapes with opposing varying slopes, i.e. unsymmetrical shapes, and shapes having cross-sections such that the sides of the rim between the inner edge 36 and 37 and outer edge 34 and 35 appear convex or concave. These shapes and other geometric shapes that assist in reducing the stress in the suspension elements 30 and 32 may be employed alone or in conjunction with one another. For purposes of this application, a "dome" can be taken to mean any of the above shapes, or any other geometric configuration that could be used to minimize the stress on a suspension element.

Figure 5:
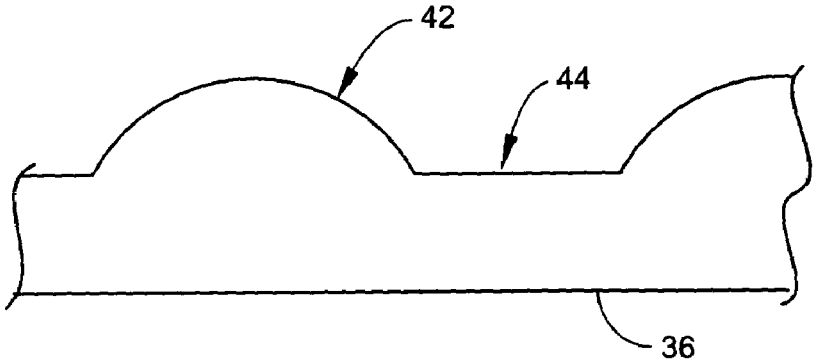
FIG. 5 is a cross-sectional view of the surround in FIG. 2 taken along the line C–C'.

As seen in FIG. 5, which is a cross-sectional view taken along the center circumference of the surround 32, which is centered between the inner edge 36 and outer edge 34 of the surround 32, the peak 42 design is graduated in that the height of the peak 42 gradually increases until it reaches the desired height, and then begins to taper back downward, eventually blending into the traditional half-circular cross-sectional portions 44 of the surround 32. Thus, when taking cross-sections of the peaks 38, the height of the parabolic cross-sections will vary.

Figure 6:
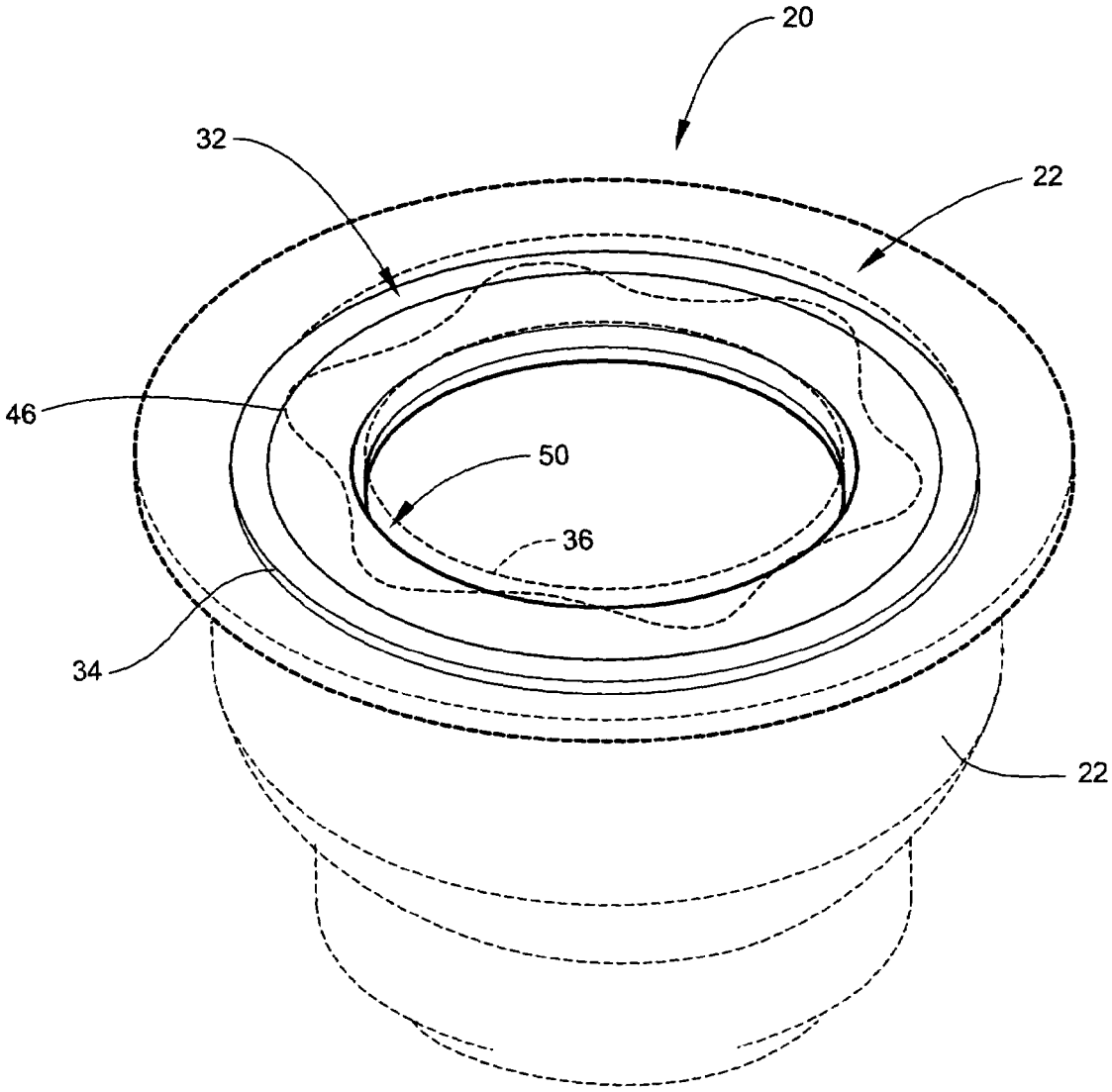
FIG. 6 is a perspective view of a speaker system having a surround varying in shape along the circumference of the surround.
Figure 7:
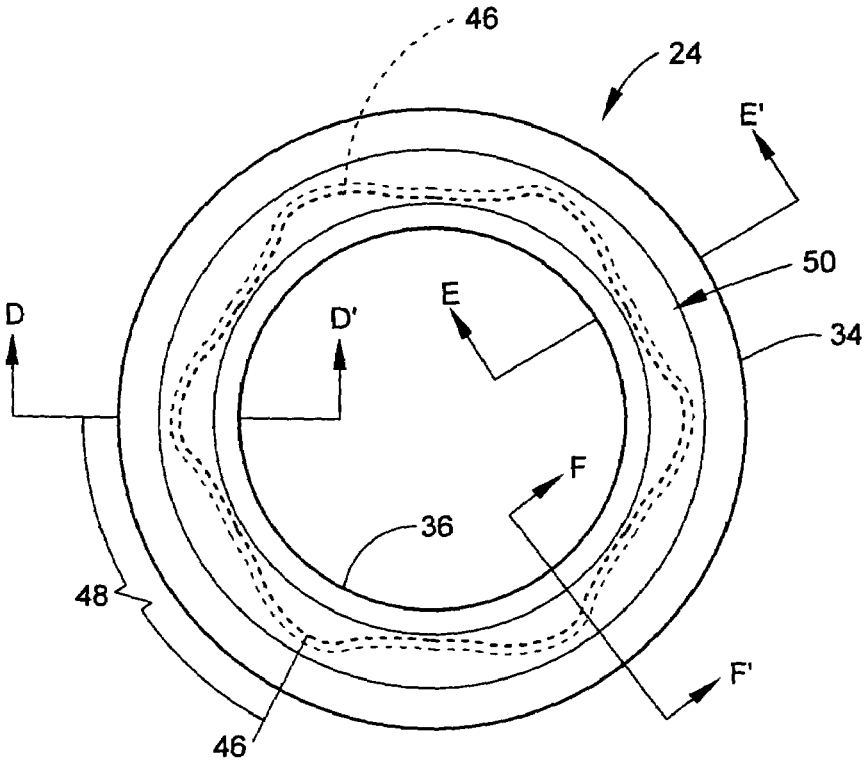
FIG. 7 is a top view of the surround in FIG. 6.

Another implementation of a geometric design that could be used in a suspension element 30 or 32 of a speaker 20 is illustrated in FIG. 6 in connection with a surround 32. In this implementation, the height of the surround 32 does not vary, although it could be designed to do so. Rather, the highest point 46 of each cross-section is varied from center, moving toward the inner edge 36, crossing center, and then back toward the outer edge 34, creating a wave effect about the center circumference of the surround. When viewed from the top, as illustrated by FIG. 7, this movement of the highest point along the surround appears as a sinusoidal wave face 48, relative to the center circumference of the surround 32.

Figure 8:
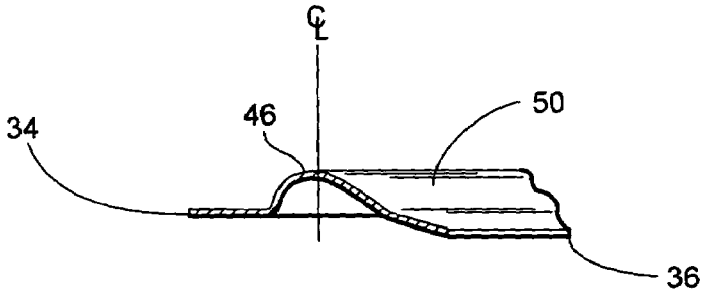
FIG. 8 is a perspective cross-sectional view of the surround in FIG. 6 taken along the line D–D'.
Figure 9:
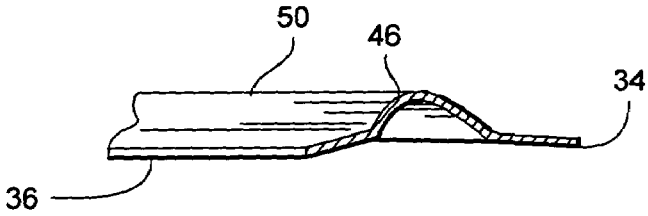
FIG. 9 is a perspective cross-sectional view of the surround in FIG. 6 taken along the line E–E'.
Figure 10:
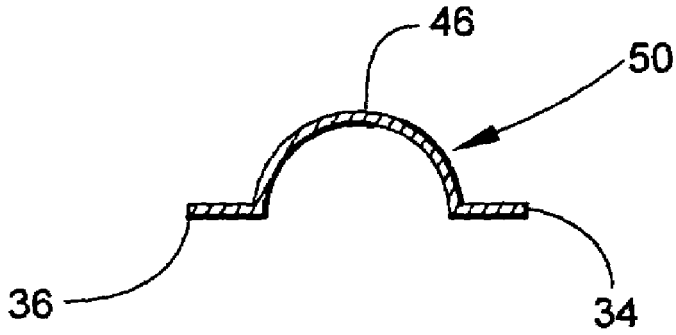
FIG. 10 is a cross-sectional view of the surround in FIG. 6, taken along the line F–F'.

FIG. 8 is a perspective cross-sectional view of the surround, which is taken when the highest point 46 of the dome, or parabola 50, is closer to the outer edge 34, such that the slope of the dome 50 on the side of the outer edge 34 is greater than the slope of the dome 50 on the side of the inner edge 36. On the other hand, the highest point 46 of the dome 50 in FIG. 9 is closer to the inner edge 36, such that the slope of the dome 50 on the side of the outer edge 34 is less than the slope of the dome on the side of the inner edge 36. FIG. 10 shows the highest point 46 of the dome 50 as it crosses center, creating the traditional half-circular shaped cross-section 44.

Figure 11:
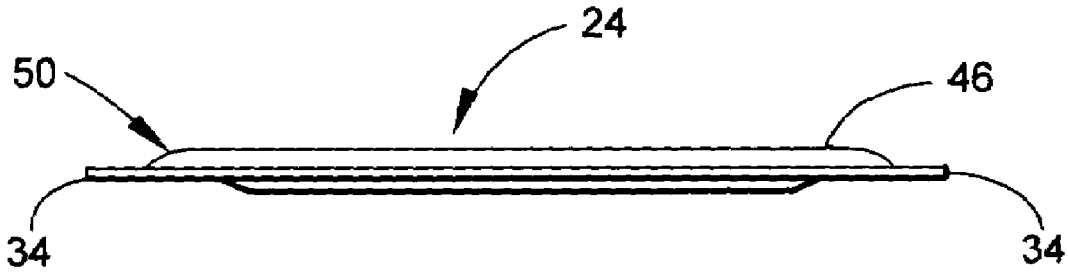
FIG. 11 is a side view of the surround in FIG. 6.

FIG. 11 is a side view of the surround 32 showing that the height of the dome 50 is uniform along the circumference of the surround, unlike the surround in FIGS. 1–5. Alternatively, variable or constant peaks, or variable arced sections, may also be implemented, alone or in conjunction with other geometric configurations, extending all the way around the perimeter of the surround or only across portions of the surround.

Figure 12:
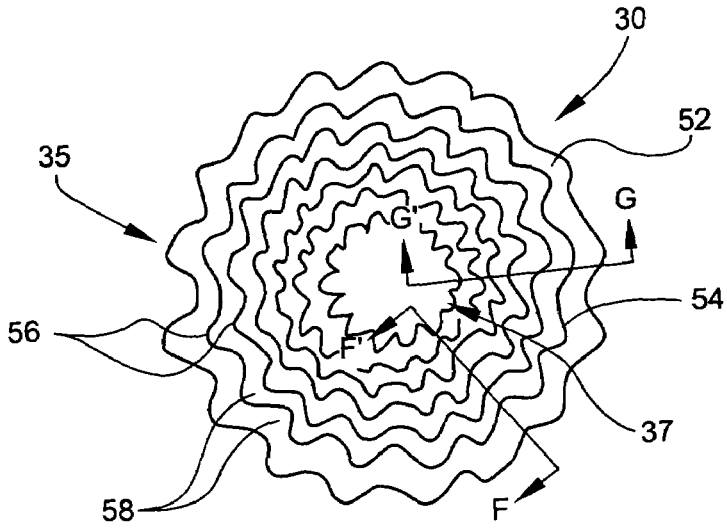
FIG. 12 is a top view of a spider having a parabolic shape along the ridges and grooves of the spider.

FIG. 12 is a top view of a spider 30 employing the same geometric configurations of the surround 32 of FIG. 6. Like the implementation of this configuration in the surround 32, the height of the grooves 52 and ridges 54 of the spider 30 does not vary, although they could be designed to do so. Rather, the highest point 56 of the ridges 54 and the lowest point 58 of the grooves 52 are varied from center, moving toward the inner edge 37 of the spider 30, crossing the center of the ridge or groove, and then back toward the outer edge 35 of the spider, creating a wave effect about the center circumference of each groove 52 and ridge 54. When viewed from the top, as illustrated by FIG. 12, this movement along the circumference of the spider 30 appears as a sinusoidal wave, along each ridge 54 of the spider 30, the same wave shape would appear on the underside of the spider 30 along each groove 52.

Figure 13:
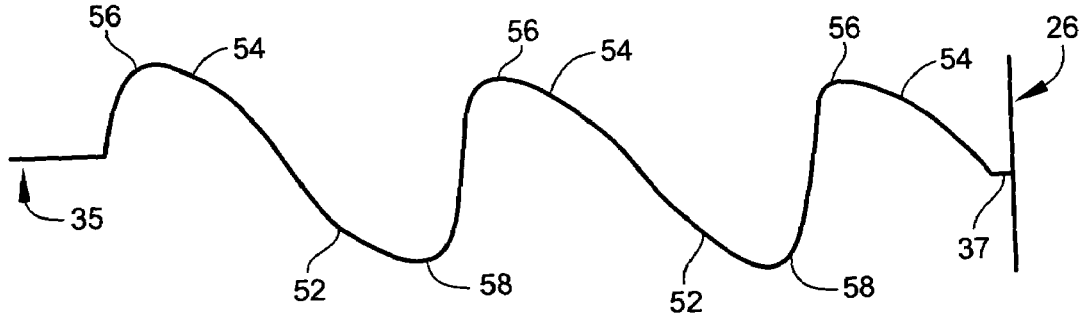
FIG. 13 is a cross-sectional view of the spider in FIG. 12 taken along line F–F'.
Figure 14:
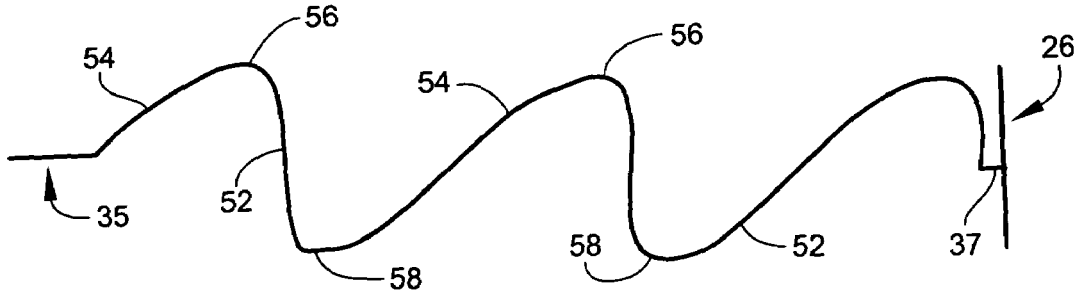
FIG. 14 is a cross-sectional view of the spider in FIG. 12 taken along line G–G'.
Figure 15:
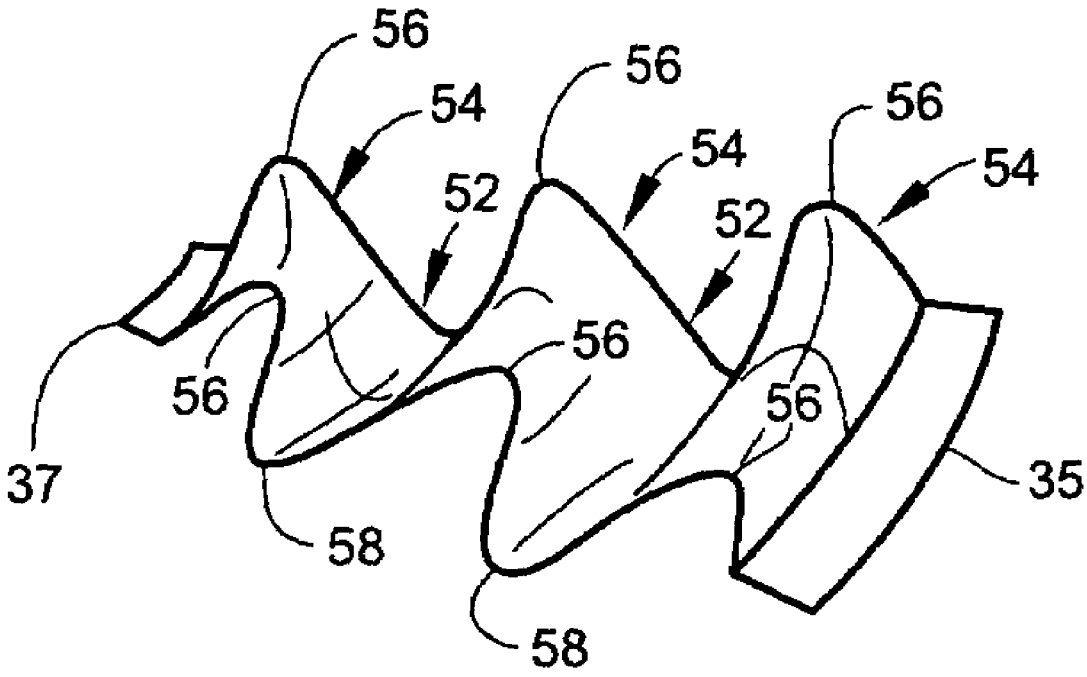
FIG. 15 is a perspective cross-sectional view of a segment of the spider in FIG. 12 taken between line G–G' and line F–F'.

FIG. 13 is a perspective cross-sectional view of the suspension system, which is taken when the highest point 56 of the ridge 54 is closer to the outer edge 35 and the lowest point 58 of the groove 52 is closer to the inner edge 37. In contrast, the highest point 56 of the ridge 54 in FIG. 14 is closer to the inner edge 37 and the lowest point 58 of the groove 52 is closer to the outer edge. FIG. 15 is a perspective view of a segment of the spider 30, which illustrates that the shifting of the highest points 56 of the ridge 54 and lowest points 58 of the groove 52 creates a wave about the circumference of each ridge 54 and groove 52 of the spider 30.

Figure 16:
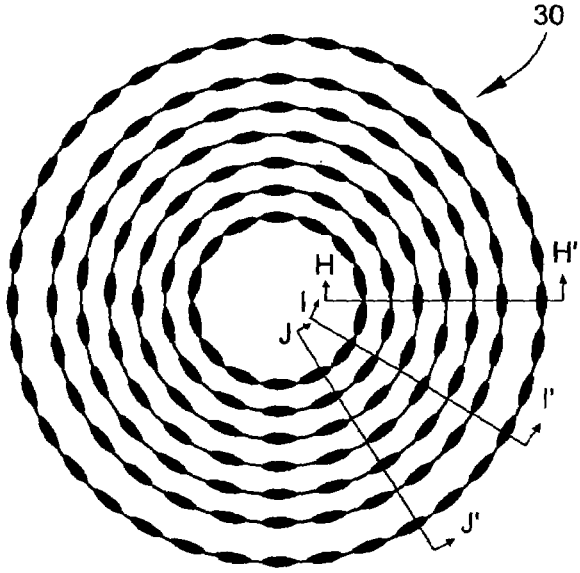
FIG. 16 is a top view of a spider having ridges and grooves that are both generally concave and convex in cross-sectional shape at various points along the spider.
Figure 17:
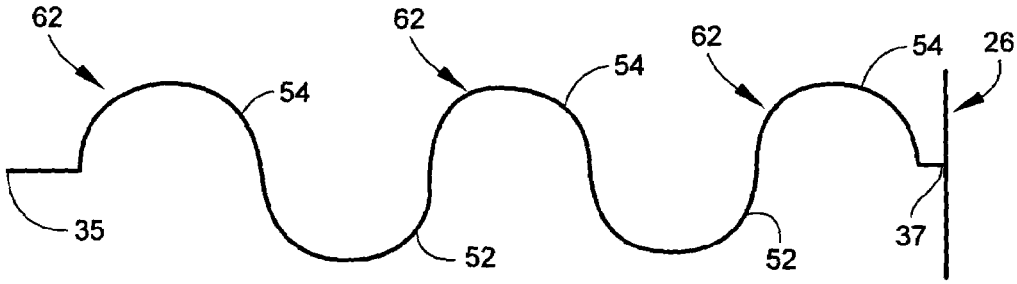
FIG. 17 is a cross-sectional view of the spider in FIG. 16 taken along line H–H'.
Figure 18:
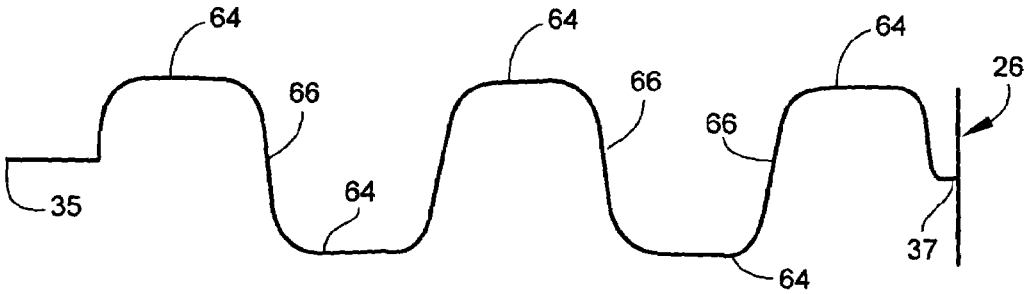
FIG. 18 is a cross-sectional view of the spider in FIG. 16 taken along line I–I'.
Figure 19:
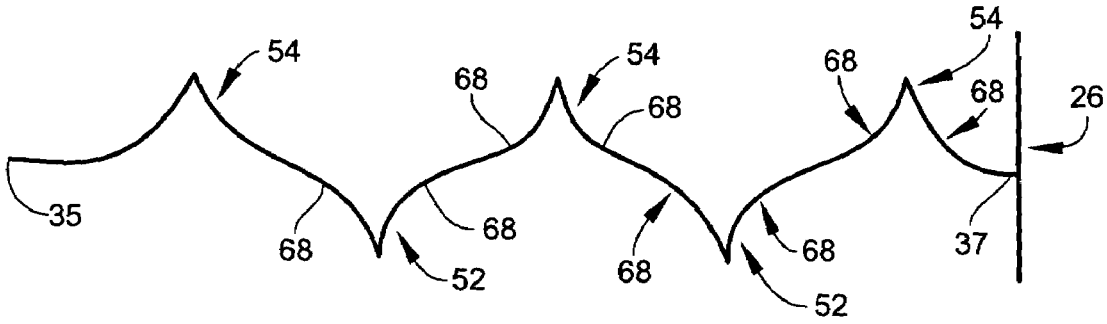
FIG. 19 is a cross-sectional view of the spider in FIG. 16 take along line J–J'.
Figure 20:
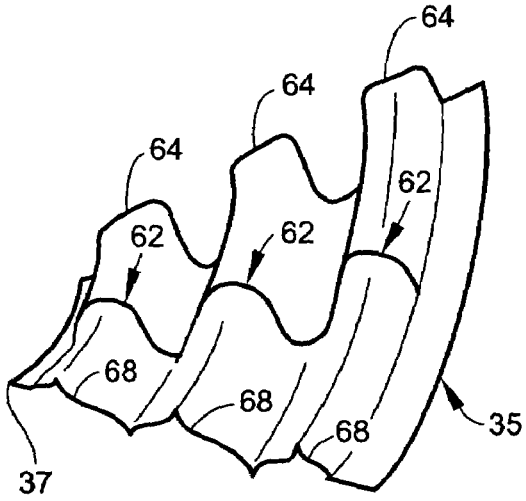
FIG. 20 is a perspective cross-sectional view of a segment of the spider in FIG. 16 taken between line H–H' and line J–J'.

Yet another implementation of a geometric design that could be used in a suspension element 30 or 32 of a speaker 20 is illustrated in FIG. 16 in connection with a spider 30. As best illustrated by FIGS. 17–19, both the ridges 54 and the grooves 52 vary in cross-section from a parabola 62, as illustrated by FIG. 17, to a configuration having a generally flat top 64 and sides at only slight angles 66, as illustrated in FIG. 18, to a configuration having convex sides 68, as illustrated by FIG. 19. Along the circumference of the grooves 56 and ridges 54 of the spider 30, these configurations blend into one another, as illustrated by FIG. 20.

In operation, the implementation of the different geometric design decreases the stress on the suspension elements 30 and/or 32. For example, when the surround 32 employs peaks 42, as the diaphragm 24 moves upward expanding the surround 32, the peaks 42 will flatten, giving the surround 32 greater ability to expand in both the tangential 40 and radial direction 38. When the surround 32 employs the sinusoidal wave face 48 design, the sinusoidal wave face 48, as the surround 32 expands, will become more linear or simply circular without the sinusoidal curve relative to the center circumference of the surround. This gives the surround 24 greater ability to expand in the radial direction 38. Similarly, the expansion of the spider 30 would have the same effect. The same designs employed in the surround 32 may be employed in the spider 30. Variation of these designs discussed above may also be employed either suspension element 30 or 32. Varying peaks 42 may be included in the sinusoidal wave face implementation 48, such that the height of the dome 50 or ridge 54, as the case may be, would no longer be uniform. Additionally, waves may be implemented in segments in either the spider 30 or the surround 32 similar to the implementation of the peaks 42 in the surround 32 as shown in FIG. 2, and may either vary in height or be uniform. Any other geometric design that functions to relieve radial and/or tangential stress when the surround 32 or spider 30 is expands, can also be employed.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A suspension element comprising an outer edge, an inner edge, and a cross-section between the inner and outer edges, the cross-section comprising a plurality of uniform sections and a plurality of peaked sections, where each uniform section has a uniform cross-sectional height above the inner and outer edges, and each peaked section comprises a peak of greater cross-sectional height above the inner and outer edges than the uniform cross-sectional height.

2. The suspension element of claim 1 where the suspension element is generally circular in shape.

3. The suspension element of claim 1, where the cross-section is part of a surround.

4. The suspension element of claim 1, where the cross-section is part of a spider.

5. The suspension element of claim 1, where the cross-section is shaped generally like a dome.

6. The suspension element of claim 1, where the cross-section at the uniform sections is generally shaped like a half-circle.

7. The suspension element of claim 1, where the cross-sectional height of each peaked section varies along at least a portion of the circumference of the suspension element.

8. The suspension element of claim 1, where the cross-section at the peaked sections is generally shaped like a parabola.

9. The suspension element of claim 1, where the cross-section at the peaked sections is generally symmetrical about the peak.

10. The suspension element of claim 1, where the cross-section at the peaked sections is generally asymmetrical about the peek.

11. The suspension element of claim 1, where the cross-section at the peaked sections comprises a concave side.

12. The suspension element of claim 1, where the cross-section at the peaked sections comprises a convex side.

13. The suspension element of claim 1, where the cross-section at the peaked sections has a generally flat top.

14. The suspension element of claim 1, where each peaked section is interposed between adjacent uniform sections.

15. The suspension element of claim 1, where at least one of the uniform sections extends for an arc length along a circumference of the suspension element.

16. A method for enabling extension of a suspension element in a radial direction and a tangential direction, comprising providing a cross-section between an inner edge and an outer edge of the suspension element, the cross-section comprising a plurality of uniform sections and a plurality of peaked sections, where each uniform section has a uniform cross-sectional height above the inner and outer edges, and each peaked section comprises a peak of greater cross-sectional height above the inner and outer edges than the uniform cross-sectional height.

17. The method of claim 16, where the suspension element is generally circular in shape.

18. The method of claim 16, where the cross-section is part of a surround.

19. The method of claim 16, where the cross-section is part of a spider.

20. The method of claim 16, where the cross-section is shaped generally like a dome.

21. The method of claim 16, where the cross-section at the uniform sections is generally shaped like a half-circle.

22. The method of claim 16, where the cross-sectional height of each peaked section vales along at least a portion of the circumference of the suspension element.

23. The method of claim 16, where the cross-section at the peaked sections is generally shaped like a parabola.

24. The method of claim 16, where the cross-section at the peaked sections is generally symmetrical about the peak.

25. The method of claim 16, where the cross-section at the peaked sections is generally asymmetrical about the peak.

26. The method of claim 16, where the cross-section at the peaked sections comprises a concave side.

27. The method of claim 16, where the cross-section at the peaked sections comprises a convex side.

28. The method of claim 16, where the cross-section at the peaked sections has a generally flat top.

29. The method of claim 16, where each peaked section is interposed between adjacent uniform sections.

30. The method of claim 16, where at least one of the uniform sections extends for an arc length along a circumference of the suspension element.

31. A suspension element comprising an outer edge, an inner edge, and a ridge interposed between the inner and outer edges, the ridge extending continuously above the inner and outer edges along a circumference of the suspension element where a cross-section of the ridge defined between the inner and outer edges varies in shape along the circumference.

32. The suspension element of claim 31, where the cross-section varies from a generally domed shape to a different shape.

33. The suspension element of claim 31 where the different shape is a generally flat topped shape.

34. The suspension element of claim 33 where the cross-section varies between the generally domed shape, the generally flat topped shape, and a shape including convex sides.

35. The suspension element of claim 32 where the different shape is a shape including convex sides.

36. The suspension element of claim 31, where the cross-section varies from a generally flat topped shape to a different shape.

37. The suspension element of claim 36 where the different shape is a shape including convex sides.

38. The suspension element of claim 31, where the cross-section varies from a shape including convex sides to a different shape.

39. The suspension element of claim 31 where the ridge is part of a surround.

40. The suspension element of claim 39 where the ridge is part of a spider.

41. A method for enabling extension of a suspension element in a radial direction and a tangential direction, comprising providing a ridge interposed between the inner and outer edges, the ridge extending continuously above the inner and outer edges along a circumference of the suspension element, where a cross-section of the ridge defined between the inner and outer edges varies in shape along the circumference.

42. The method of claim 41, where the cross-section varies from a generally domed shape to a different shape.

43. The method of claim 42 where the different shape is a generally flat topped shape.

44. The method of claim 43 where the cross-section varies between the generally domed shape, the generally flat topped shape, and a shape including convex sides.

45. The method of claim 42 where the different shape is a shape including convex sides.

46. The method of claim 41, where the cross-section varies from a generally flat topped shape to a different shape.

47. The method of claim 46 where the different shape is a shape including convex sides.

48. The method of claim 41, where the cross-section varies from a shape including convex sides to a different shape.

49. The method of claim 41 where the ridge is part of a surround.

50. The method of claim 41 where the ridge is part of a spider.

* * * * *